United States Patent [19]

Genba et al.

[11] Patent Number: 4,612,157

[45] Date of Patent: Sep. 16, 1986

[54] METHOD FOR PRODUCTION OF HIGH-TENACITY, FINE-DENIER POLYVINYL ALCOHOL FIBER

[75] Inventors: Tsuneo Genba; Akio Mizobe; Masaki Okazaki; Isao Sakuragi, all of Okayama, Japan

[73] Assignee: Kuraray Company, Limited, Kurashiki, Japan

[21] Appl. No.: 690,578

[22] Filed: Jan. 11, 1985

[30] Foreign Application Priority Data

Jan. 31, 1984 [JP] Japan ..... 59-17484

[51] Int. Cl.[4] ..... D01F 6/14

[52] U.S. Cl. ..... 264/185; 264/210.8

[58] Field of Search ..... 264/185, 210.8; 57/237

[56] References Cited

U.S. PATENT DOCUMENTS

| | | | |
|---|---|---|---|
| 3,660,556 | 5/1972 | Ashikaga et al. | 264/185 |
| 3,776,994 | 12/1973 | Yoshioka et al. | 264/185 |
| 3,826,298 | 7/1974 | Tanaka et al. | 57/237 |
| 3,850,901 | 11/1974 | Tanaka et al. | 264/185 |
| 3,850,902 | 11/1974 | Metcalfe et al. | 264/1.1 |
| 3,852,402 | 12/1974 | Tanaka et al. | 264/185 |
| 4,264,676 | 4/1981 | Uzumaki et al. | 264/185 |

FOREIGN PATENT DOCUMENTS

| | | |
|---|---|---|
| 47-31376 | 8/1972 | Japan . |
| 52-005318 | 1/1977 | Japan . |
| 54-030930 | 3/1979 | Japan . |
| 54-077720 | 6/1979 | Japan . |

*Primary Examiner*—James Lowe
*Assistant Examiner*—Hubert C. Lorin
*Attorney, Agent, or Firm*—Oblon, Fisher, Spivak, McClelland & Maier

[57] ABSTRACT

A fine-denier, high-tenacity, water-resistant polyvinyl alcohol fiber is produced by dissolving a polyvinyl alcohol having an average degree of polymerization between 1,200 and 3,000, boric acid or a salt thereof in a proportion of 0.5 to 5 weight percent relative to said polyvinyl alcohol and an acid for adjusting a final spinning solution to pH 5 or less in water to prepare an aqueous solution containing 8 to 14 weight percent of said polyvinyl alcohol, discharging said aqueous solution as said spinning dope from a spinneret nozzle having an average orifice diameter of 0.02 to 0.04 millimeters into a bath comprising an aqueous solution containing alkali and dehydrating salt at a bath draft within a range of 10 to −60 percent, and finally stretching the resulting tow at least 10-fold. The fine-denier fiber thus obtained has a marked reinforcing effect on various materials, particularly inorganic hydraulic materials such as cement.

7 Claims, No Drawings

METHOD FOR PRODUCTION OF HIGH-TENACITY, FINE-DENIER POLYVINYL ALCOHOL FIBER

BACKGROUND OF THE INVENTION

1. Field of the Invention

This invention relates to a fine-denier, high-tenacity, water-resistant polyvinyl alcohol synthetic fiber and a method for its production.

2. Description of the Prior Art

A typical use for fine-denier fiber is synthetic leather. The principal method for producing such fine-denier fiber comprises mix-spinning two incompatible, heat-fusible polymer chip materials to prepare an "oceano-insular" composite fiber, processing the fiber into a two-dimensional article such as a nonwoven fabric, and extracting out the oceanic phase (sea component) of said fiber to leaving the insular phase (island component) alone and providing a shaped article made up of fine-denier fiber. Although this production method is suitable for applications in which a two-dimensional structure cannot be easily fabricated directly from fine-denier fiber, the fine-denier fiber obtainable by such a method is low in strength, and though useful for synthetic leather, is inadequate for use as an industrial material. Moreover, as the method includes a step of extracting and removing said oceanic phase, it entails wastes in materials and procedures, with the result that the cost of the product fine-denier fiber is necessarily high.

Attempts have also been made to manufacture fine-denier fiber from polyvinyl alcohol (hereinafter referred to abbreviated form as PVA).

Japanese Patent Publication No. 31376/1972, for instance, teaches the art of manufacturing a fine-denier fiber for papermaking use which comprises mix-spinning completely saponified PVA with sparingly saponified PVA, stretching and heat-treating the resulting tow to give an ordinary-denier fiber, and beating the same to give a fibril-like, fine-denier fiber for papermaking use. In this method, as it employs a partially saponified PVA with a large side chain, the mix-spun fiber is difficult to stretch and, moreover, crystallization is markedly inhibited. Therefore, while the fiber is low in strength and water resistance even before the beating process, the mechanical beating disturbs the orientation of molecules in the amorphous phase and of crystals and even destroys the crystals so that the strength and water resistance are still further sacrificed.

Japanese Patent Publication Kokai Sho 54-77720 discloses a method of producing PVA fine fiber. This method, too, is a technique for mix-spinning a highly saponified PVA with a partially saponified PVA, and the characteristic feature of this technique lies in the removal of the low-saponified PVA from the resulting ordinary-denier fiber by aqueous washing. The difference between this method and the preceding method is that whereas the means used for converting ordinary-denier fiber into fine-denier fiber in the preceding method is that of removing the low-saponified PVA with the aid of mechanical beating so as to achieve fibrilization, the means employed in the latter method causes the low-saponified PVA to swell considerably and be washed off with water. In either method, the resulting fine-denier fiber is low in tenacity and water resistance.

The method described in Japanese Patent Publication No. Sho 58-38526 is also similar to the above-mentioned methods in that it employs a PVA of low polymerization degree as the partially saponified PVA and the fiber obtainable by the method is also low in tenacity and water resistance. For example, the fine PVA fibril shown as a working example of the patent application is of low tenacity. Even in the form of an ordinary-denier fiber prior to aqueous washing it has a low tenacity of only 3.4 g/denier.

Japanese Patent Publication Kokai Sho 54-30930 teaches a method comprising the use of an amorphous water-soluble polymer in lieu of a low-saponified PVA but the method is essentially the same as the above-mentioned methods.

In any event, the prior art comprises mix-spinning a crystalline PVA which is to become a strength fraction and a polymer which is low in crystallinity and readily soluble in water and removing the readily soluble fraction from the resulting ordinary-denier fiber to give a fine denier fiber. The fibers according to the foregoing methods are not only invariably low in tenacity and water resistance but also require a step for removing a component thereof in their production sequence, the component removed representing a loss of material. In other words, these fibers are of necessity costly.

Recently there has been an increasing need for fine-denier PVA fiber of high tenacity, high water resistance and low production cost. A typical application for such fiber is that of reinforcing brittle materials such as cured cement and low-strength plastic materials such as some synthetic resins.

For a fiber to be useful as a reinforcement, not only high strength but also the adhesivity of the fiber to the matrix material is an important factor. Reducing the diameter (denier number) of such fiber means an increased available area of contact with a matrix and, hence, an improved adhesivity to enhance the reinforcing effect. Moreover, the moldability of the product is also remarkably improved.

When the matrix is a hydraulic material, water resistance is an important requirement. Thus, since the fiber is exposed to water of comparatively high temperature during setting, it should not swell or decrease in strength under such conditions.

The ordinary PVA fiber has been used in various industrial materials for reasons of its high tenacity. As this fiber has a very high Young's modulus, the yarn, cord, rope, net, fabric and other products made thereof are characteristically high in rigidity and this is a disadvantage in certain applications. For such uses, it is effective to reduce the denier number of monofilaments. Moreover, reducing the denier number leads to an improved tenacity utilization rate which in turn results in an increased strength of products.

Furthermore, in recent years, germ- and dust-free rooms or workplace have been required in hospitals and in the electronics industry, for instance. To meet this requirement, high-performance filters are strongly demanded. For this purpose, nonwoven fabrics made of fine-denier fiber are effective.

As mentioned above, a high-tenacity, fine-denier, water-resistant PVA fiber is desired.

SUMMARY OF THE INVENTION

A primary object of the invention is to provide a high-tenacity, fine-denier, water-resistant PVA fiber. Another object is to provide a method of producing said fiber at low cost.

The method according to the invention is quite distinct from the expensive known methods such as the one comprising removal of the oceanic phase by dissolution. It simply uses ordinary spinning facilities while employing specific conditions. Accordingly, it is a very inexpensive, economical method.

Thus, the invention provides a PVA fiber meeting the requirements: a monofilament fineness of 0.05 to 0.5 denier, a tensile strength of not less than 9.0 g/denier and a softening point in water of not lower than 105° C.; as well as a method of producing a fine-denier PVA fiber which comprises dissolving in water a polyvinyl alcohol having an average degree of polymerization between 1,200 and 3,000, boric acid or a salt thereof, in a proportion of 0.5 to 5 weight percent relative to said polyvinyl alcohol and an acid for adjusting a final spinning solution to a pH of not more than 5 to prepare an aqueous solution containing 8 to 14 weight percent of said polyvinyl alcohol, and discharging said aqueous solution as the spinning solution through a spinneret having an average hole diameter of 0.02 to 0.04 millimeter into a bath comprising an aqueous solution containing alkali and dehydrating salt at a bath draft within the range of 10 to −60 percent, followed by at least 10-fold stretching.

DETAILED DESCRIPTION OF THE INVENTION

The PVA to be used in the practice of the invention has an average degree of polymerization within the range of 1,200 to 3,000 and a saponification degree of not less than 96% (not less than the degree of substantially complete saponification as attainable in the alkaline coagulating bath mentioned later). Such PVA is dissolved, together with 0.5 to 5 weight percent (on the PVA basis) of boric acid or a salt thereof and a quantity of an acid sufficient to adjust the final spinning solution to a pH of not more than 5, in water in the conventional manner to prepare an aqueous solution having a PVA concentration of 8 to 14 weight percent. This solution is used as the spinning solution. A PVA concentration below 8 percent will result in unsatisfactory coagulation, whereas a concentration exceeding 14% will result in much worsened spinning condition. A concentration of 10 to 13 weight percent is more preferable. Typical of the salt of boric acid is borax. When the amount of boric acid or a salt thereof is below 0.5 weight percent or above 5 weight percent, high-tenacity fibers cannot be obtained. As the acid to be added for adjusting the spinning solution to a pH of not more than 5, there may be mentioned organic acids such as acetic acid, tartaric acid and oxalic acid and inorganic acids such as nitric acid. Among them preferred are organic acids. To keep the pH of the spinning solution at 5 or below is very important in maintaining a good spinnability.

The spinning solution is discharged through a spinneret having holes each 0.02 to 0.04 mm in diameter into an aqueous solution containing alkali and dehydrating salt at a bath draft within the range of 10 to −60 percent. The term "bath draft" as used herein is defined by the following:

$$\text{Bath draft } \% = \frac{\text{Bath-leaving speed} - \text{Discharge speed}}{\text{Discharge speed}} \times 100$$

The term "bath-leaving speed" means the first roller speed. While the hole diameter of a wet-spinning spinneret is generally small as compared with that of a spinneret for melt-spinning or dry spinning, the smallest hole diameter usable in wet spinning of PVA fibers in the prior art is 0.05 mm, because the spinnability becomes very unstable when smaller diameters are employed. The present inventors considered that the hole diameter should be still smaller so that fine-denier fibers could be obtained. Accordingly they conducted various investigations in search of a method which enables constant and stable spinning of PVA fibers even with a spinneret having such smaller-diameter holes. As a result, it has been found that a bath draft of 10 to −60 percent, preferably 0 to −50 percent is a very important factor in securing a constant and stable condition of spinning, although removal of foreign matters from the spinning solution by high-performance filtration is required. In ordinary wet spinning, a bath draft of less than −60 percent is generally employed. When compared with such conditions, the bath draft employed in accordance with the invention may be said to be not in accordance with common sense.

A method of producing PVA fibers, which is similar to the method of the present invention, is already known. For instance, Japanese Patent Publication Sho 47-50330 (U.S. Pat. No. 3,826,298, German Patent No. 2,055,320; the applicant being the same as that in the present application) discloses that spinning of a spinning solution prepared by adding boric acid to an aqueous solution of PVA followed by washing of the fiber obtained with water and the subsequent thermal stretching gives a high-tenacity PVA fiber. However, the method described in said, publication is designed for the production of an ordinary-denier PVA fiber. The production of fine-denier fiber is not the objective of this prior art method. The bath draft conditions and the hole diameter of spinneret in the present invention, differ distinctly from the prior art spinning conditions, and are necessary conditions, recognized for the first time by Applicants in producing fine-denier PVA fibers. Since the bath draft conditions and the hole diameter of spinneret in the present invention generally offer no substantial advantages in the productions of ordinary-denier fibers, these conditions are in general not employed in the method described in the above-cited publication which are not intended for the production of fine-denier fibers.

The use of a spinneret whose hole diameter is less than 0.02 mm in carrying out the method of the invention resulted in a rather unstable condition of spinning irrespective of the bath draft.

The discharge quantity should be adjusted so that the fineness amounts to 0.05 to 0.5 denier. When the discharge quantity is so small that the resulting fiber becomes finer than 0.05 denier, constant and stable production becomes impossible due to unstable condition of spinning, such as fiber breakage in the spinning cylinder due to the thinness of the fiber. Also from the application standpoint, such finer fiber should be cut to a length shorter than 1 mm to overcome the dispersibility problem expected to be encountered in its use as a reinforcement for cement and plastics or as a material for papermaking, but such short cutting is industrially impossible or meaningless. When the fineness exceeds 0.5 denier, the expected effects of the fine-denier fiber are unsatisfactory.

As the coagulating bath, there is used an aqueous solution containing alkali and dehydrating salt. Typical examples of the dehydrating salt are sodium sulfate and ammonium sulfate. The concentration of the dehydrating salt in said aqueous solution is 200 g/liter to the saturation amount. Typical examples of the alkali are sodium hydroxide and potassium hydroxide, and the concentration of the alkali is 1 to 100 g/liter.

The fiber thus spun is first drawn in the wet state, neutralized and washed with water. More specifically, the fiber is roller-drawn, neutralized, washed with water to thereby remove part of the remaining boric acid, and then wet-heat drawn in a sodium sulfate bath, or the fiber is roller-drawn, neutralized, wet-heat drawn, and then washed with water to thereby remove part of the residual boric acid. As a result the residual content of boric acid in the fiber is reduced to 0.1 to 0.6% by weight on the PVA basis. Higher residual boric acid contents than 0.6% by weight on the PVA basis result in much inhibited stretchability, hence in failure to give desired strength and water resistance. To reduce the boric acid content to a level below 0.1% by weight on the PVA basis, severe washing conditions are essential, so that marked swelling and deterioration in quality of the fiber are unavoidable.

The overall drawing in the wet part (i.e., in the above case, the product of the degree of stretching in roller drawing and that in wet-heat drawing) should preferably be at least 3 times, more preferably 4 times or more.

Thereafter, the fiber is dried, followed by dry-heat drawing such that the overall drawing amounts to 10 times or more. The fiber is further subjected to thermal shrinkage and/or heat treatment, as necessary, so that a softening point in water of not lower than 105° C. can be obtained. A strength of not less than 9.0 g/denier cannot be obtained without 10 times or more stretching. A fiber having a tensile strength of less than 9.0 g/denier produces only unsatisfactory effects as a reinforcing fiber and moreover lacks in applicability as a material for general industrial use.

The softening point in water is an important factor particularly when the fiber is intended for use in reinforcing material capable of hardening underwater, such as cement. A fiber having a softening point in water lower than 105° C. becomes swollen in the shaping step and loses its inherent strength, so that its reinforcing effects are much reduced. Also in general applications where after-treatment in an aqueous system is often encountered, drying after treatment at 105° C. causes swelling and reduction in strength of such fiber or presents other problems such as agglutination due to partial melting of the fiber surface. To achieve a higher softening point in water, it is effective to increase the degree of drawing or to employ severer heat treatment conditions. The term "softening point in water" as used herein is the temperature as measured by the following method:

Softening point in water: Filaments are taken out randomly such that the resulting filament bundle has a fineness of about 1,000 denier. After paralleling, a bundle denier × 1/500 gram weight is attached to one end of the fiber bundle and the bundle is fixed, at the point 10 cm from the weight, on a scale plate. The plate with the fiber bundle is immersed, in a vertical position, in water placed in a glass tube capable of being pressured. The temperature is raised from room temperature at a rate of about 1° C. per minute. The temperature at which the shrinkage of the fiber bundle reaches 10% or the bundle is broken due to melting is reported as the softening point in water.

The PVA fiber thus obtained has favorable physical characteristics, namely a fineness of 0.05 to 0.5 denier, a strength of not less than 9.0 g/dr, and a softening point in water of not lower than 105° C. Moreover, in accordance with the invention, such fine-denier fiber can be produced at a cost differing little from the cost of ordinary-denier PVA fibers since the conventional wet process and production facilities can be used for its production and the spinnability is very good, which leads to high productivity.

The following examples illustrate the invention in further detail.

EXAMPLES 1 & 2 AND COMPARATIVE EXAMPLES 1 & 2

An aqueous spinning solution having a PVA concentration of 13% by weight and a pH of 4.5 was prepared by dissolving PVA (polymerization degree 1,750; saponification degree 99.0 mole %) in water, together with 1.5 and 0.3% by weight (on the PVA basis) of boric acid and acetic acid, respectively.

This spinning solution was discharged through a spinneret having 10,000 holes, 0.03 mm in diameter, into a coagulating bath comprising an aqueous solution containing 50 g/liter of sodium hydroxide and 300 g/liter of sodium sulfate, to thereby cause filament formation, while bath drafts of −10% (Example 1), −40% (Example 2), +20% (Comparative Example 1) and −70% (Comparative Example 2) were attained by varying the discharge amount. The bath-leaving speed was 10 m/minute. The filaments were 2.5-fold drawn between rollers, neutralized, wet-heat drawn 1.8-fold, washed with water until the residual boric acid content of 0.3% by weight (on the PVA basis) was attained, and then bundled and dried. Thereafter, the tow was further subjected to 2.8-fold dry-heat drawing, so that the total drawing amounted to 12.6 times, and then to thermal shrinkage by 2%.

The spinnability was evaluated by performing 8-hour continuous spinning on 10 spinnerets. The evaluation results are shown in Table 1 together with the results of quality parameter measurements.

TABLE 1

| | Bath draft (%) | Denier | Strength (g/dr) | Softening point in water (°C.) | Spinnability |
|---|---|---|---|---|---|
| Example 1 | −10 | 0.07 | 12.5 | 116 | O |
| 2 | −40 | 0.11 | 13.0 | 116 | O |
| Comparative Example 1 | +20 | 0.06 | 11.0 | 113 | X |
| 2 | −70 | 0.22 | 12.0 | 114 | X |

The spinnability was quite satisfactory and the products were superior in quality in Examples 1 and 2 as compared with Comparative Examples 1 and 2.

EXAMPLE 3 AND COMPARATIVE EXAMPLES 3 AND 4

Aqueous spinning solutions respectively having PVA concentrations of 11% by weight (Example 3), 7% by weight (Comparative Example 3) and 16% by weight (Comparative Example 4) (each having a pH of 4.5) were prepared by dissolving PVA (polymerization degree 1,650; saponification degree 99.9 mole %) in water, together with 2.0 and 0.3% by weight (on the PVA basis) of boric acid and acetic acid, respectively. Each spinning solution was discharged through a spinneret having 10,000 holes, 0.03 mm in diameter, into a coagulating bath comprising an aqueous solution containing 20 g/liter of sodium hydroxide and 350 g/liter of sodium sulfate, to thereby cause filament formation, while maintaining a bath draft of −40% and a bath-leaving velocity of 10 m/minute. The filaments thus obtained were roller-drawn 2 times, neutralized, washed with water to residual boric acid content of 0.4% by weight (on the PVA basis), treated in a sodium sulfate bath, and subjected to 4.5-fold wet-heat drawing. They were further subjected to dry-heat drawing so that the total drawing amounted to 12.5 times. In cases where such 12.5-fold drawing could not be realized, the rate of drawing at which breakage occurred was measured and 80% of said rate was employed as the total rate of drawing. The filaments were continuedly subjected to thermal shrinkage by 2%, oiling, drying and quality parameter measurements.

The results thus obtained are shown in Table 2.

TABLE 2

| | PVA concentration (%) | Denier | Total drawing (times) | Strength (g/dr) | Softening point in water (°C.) | Spinnability |
|---|---|---|---|---|---|---|
| Example 3 | 11.0 | 0.09 | 12.5 | 13.5 | 116 | O |
| Comparative Example 3 | 7.0 | 0.06 | — | — | — | Spinning impossible |
| 4 | 16.5 | 0.22 | 8.0 | 7.5 | 106 | X |

As compared with Comparative Examples 3 and 4, the spinnability was good and the product was of high grade in Example 3.

EXAMPLES 4 & 5 AND COMPARATIVE EXAMPLE 5

The procedure and conditions of Example 3 were used except that the spinning solution had a concentration of 13.0% (pH 4.5) and the total drawing amounted to 13.5 times (Example 4), 10.5 times (Example 5) or 8.5 times (Comparative Example 5). The results obtained are summarized in Table 3.

TABLE 3

| | Total drawing (times) | Denier | Strength (g/dr) | Softening point in water (°C.) |
|---|---|---|---|---|
| Example 4 | 13.5 | 0.10 | 13.5 | 117 |
| 5 | 10.5 | 0.13 | 11.5 | 115 |
| Comparative Example 5 | 8.5 | 0.16 | 8.0 | 104 |

What is claimed as new and desired to be secured by Letters Patent of the United States is:

1. A method of producing a fine-denier polyvinyl alcohol fiber having a monofilament fineness of 0.05 to 0.5 denier, comprising:

(a) preparing an aqueous spinning solution containing 8 to 14 weight percent of polyvinyl alcohol by dissolving in water:

(i) a polyvinyl alcohol having an average degree of polymerization between 1200 and 3000, (ii) boric acid or a salt thereof in a proportion of 0.5 to 5 weight percent relative to the polyvinyl alcohol of (i), and (iii) an acid, wherein the amount of said acid employed is that amount which adjusts the pH of the aqueous spinning solution to $\leqq 5$;

(b) discharging said spinning solution through a spinneret having an average hole diameter between 0.02 and 0.04 millimeters into a coagulating bath comprising an alkali containing aqueous solution and a dehydrating salt at a bath draft between 10 to 60 percent, (c) stretching the resulting filament from step (b) at least ten-fold, and (d) recovering a fine-denier polyvinyl alcohol fiber.

2. The method of claim 1 wherein said salt of boric acid is borax.

3. The method of claim 1 wherein said dehydrating salt is sodium sulfate or ammonium sulfate.

4. The method of claim 1 wherein the concentration of the dehydrating salt in said coagulating bath is between 200 g/liter and the saturation point of said dehydrating salt.

5. The method of claim 1 wherein the concentration of alkali in said coagulating bath is between 1 and 100 g/liter.

6. The method of claim 1, wherein said spinning solution has a polyvinyl alcohol concentration of 10 to 13 weight percent.

7. The method of claim 1, wherein the bath draft is 0 to −50 percent.

* * * * *